US009404716B2

(12) United States Patent
Shoshan et al.

(10) Patent No.: US 9,404,716 B2
(45) Date of Patent: Aug. 2, 2016

(54) HYBRID SLAT ARMOR

(71) Applicant: Plasan Sasa Ltd., M.P. Marom Hagalil (IL)

(72) Inventors: Amir Ben Shoshan, D.N. Chevel Korazim (IL); Amir Laor, Kibbutz Dan (IL); Shai Eyal, Sede Illan (IL); Thomas Showken, Kfar Kama (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 10 days.

(21) Appl. No.: 14/250,133

(22) Filed: Apr. 10, 2014

(65) Prior Publication Data

US 2015/0226526 A1 Aug. 13, 2015

(30) Foreign Application Priority Data

Apr. 18, 2013 (IL) ..... 225826

(51) Int. Cl.
*F41H 5/02* (2006.01)
*F41H 5/00* (2006.01)

(52) U.S. Cl.
CPC ..... *F41H 5/00* (2013.01); *F41H 5/026* (2013.01); *F41H 5/02* (2013.01)

(58) Field of Classification Search
CPC ..... F41H 5/026; F41H 5/02; F41H 5/007; F41A 5/026
USPC ..... 89/36.12, 36.14, 36.08, 36.01, 36.02, 89/36.13, 918; 114/9, 10, 11, 12, 13, 14, 114/240 D, 240 R
See application file for complete search history.

(56) References Cited

U.S. PATENT DOCUMENTS 247,251 A * 9/1881 Henze ..... B63B 3/10 114/13
1,035,573 A * 8/1912 Gathmann ..... B63B 3/10 109/85

(Continued)

FOREIGN PATENT DOCUMENTS

FR EP 2463614 A1 * 6/2012 ..... F41H 5/023
GB 2494457 3/2013

(Continued)

OTHER PUBLICATIONS

European Search Report from European Application No. EP 14164496 mailed Nov. 7, 2014.

*Primary Examiner* — Samir Abdosh
*Assistant Examiner* — John D. Cooper
(74) *Attorney, Agent, or Firm* — Dorsey & Whitney LLP

(57) ABSTRACT

In an embodiment, a hybrid slat armor configured for protecting a body against a threat having an anticipated impact direction. The hybrid slat armor comprises a plurality of slat units, each extending along a first longitudinal direction, the units being spaced apart along a second direction perpendicular to the first direction. Each slat unit has a strike end configured for facing the anticipated impact direction, a rear end opposite the strike end, a top set of piercing elements and a bottom set of piercing elements. The piercing elements of each set are successively arranged along the longitudinal direction of the slat unit at the strike end thereof and are spaced apart in the longitudinal direction; The piecing elements of the top set are spaced from the piercing elements of the bottom set in the second longitudinal direction to a distance which is considerably smaller than that between adjacent slat-units.

19 Claims, 6 Drawing Sheets

(56) References Cited

U.S. PATENT DOCUMENTS 1,288,967 A * 12/1918 Nobis ..... E04C 2/049 428/911
2,392,215 A * 1/1946 Abrams ..... F41H 5/026 109/21.5
3,137,205 A * 6/1964 Berge ..... B62D 55/0845 89/36.02
9,003,945 B2 * 4/2015 Vallee ..... F41H 5/026 89/36.02
2008/0257141 A1 * 10/2008 Medwell ..... F41H 5/013 89/36.02
2009/0266226 A1 * 10/2009 Beach ..... F41H 5/007 89/36.02
2011/0067561 A1 * 3/2011 Joynt ..... F41H 5/007 89/36.02
2011/0126695 A1 * 6/2011 Ravid ..... F41H 5/007 89/36.02
2011/0162518 A1 * 7/2011 Brill ..... F41H 5/007 89/36.17
2011/0232472 A1 * 9/2011 Kellner, Jr. ..... F41H 5/013 89/36.08
2012/0137866 A1 * 6/2012 Gonard ..... F41H 5/013 89/36.08
2012/0312607 A1 * 12/2012 Joynt ..... F41H 7/042 180/54.1
2013/0025443 A1 * 1/2013 Hubsch ..... F41H 5/023 89/36.02
2014/0123842 A1 * 5/2014 Kahmann ..... F41H 5/06 89/36.02
2014/0144312 A1 * 5/2014 Svensson ..... F41H 5/026 89/36.02
2015/0020678 A1 * 1/2015 Hafer ..... F41H 5/026 89/36.02

FOREIGN PATENT DOCUMENTS

GB WO 2013037823 A1 * 3/2013 ..... F41H 5/023
PL WO 2012163859 A1 * 12/2012 ..... F41H 5/026
WO WO 2009064263 A2 * 5/2009 ..... F41H 5/013
WO WO/2012/067574 5/2012
WO WO/2012/163859 12/2012

* cited by examiner

HYBRID SLAT ARMOR

CROSS-REFERENCE TO RELATED APPLICATIONS

This application claims priority to Israeli Patent Application No. 225826 filed on 18 Apr. 2013, the disclosure of which is incorporated herein, in its entirety, by this reference.

TECHNOLOGICAL FIELD

The presently disclosed subject matter relates to slat armor, in particular to slat armor having slat units comprising metal and composite components.

BACKGROUND

The armor, to which the presently disclosed subject matter refers, is often used inter alia for neutralizing the triggering mechanism of weapons, such as for example a rocket propelled grenade (RPG), known to be a shoulder-fired, anti-tank weapon commonly used against vehicles, which typically fires rockets equipped with an explosive warhead.

FIG. 1 is illustrates one example of an RPG warhead 10 having a conductive cone 12 encased in an aerodynamic cover 13. An electric trigger 11, which can be for example a piezoelectric fuze, is mounted at the top of aerodynamic c cover 13 and is coupled to the edge of the conductive cone 12. The warhead 10 further includes a body 16 filled with explosive 17 and a conductor 18, electrically coupled to conductive cone 12. Body 16 includes a conical liner 14 which is configured to focus the effect of the explosive's energy. The rocket 10 is propelled using a motor located in the tail section 19 thereof.

When the warhead 10 hits the target, the trigger 11 actuates an electric signal, which is transmitted through conductive cone 12 to conductor 18, which in return sets off the explosives 17. The explosive is then urged through an aperture in the conical liner toward the target.

Slat armor is known to typically include a rigid grid deployed around the vehicle, which can naturalize the warhead, either by deforming the conical liner, or by short-circuiting the fuzing mechanism of the warhead. The slat armor is in the form of a rigid grid disposed in a predetermined distance from the vehicle, so as to allow the armor to come in contact with the cover of the RPG in order to neutralize it before the trigger hits the vehicle's body. The distance between the grid and the body of the vehicle is known as the standoff.

The slat armor can include a flexible mesh having rigid elements spaced from one another in such a way as not to allow an RPG warhead to hit the mesh without contacting at least one rigid element. Thus, the rigid element neutralizes the devastating effect of the warhead by deforming the conical liner and/or by short-circuiting the fuzing mechanism.

GENERAL DESCRIPTION

In accordance with one aspect of the subject matter of the present application, there is provided a hybrid slat armor configured for protecting a body against a threat having an anticipated impact direction, said hybrid slat armor comprising a plurality of slat units, each extending along a first longitudinal direction, the units being spaced apart along a second direction perpendicular to the first direction; each slat unit having a strike end configured for facing the anticipated impact direction, a rear end opposite said strike end, a top set of piercing elements and a bottom set of piercing elements, the piercing elements of each set being successively arranged along the longitudinal direction of the slat unit at the strike end thereof and being spaced apart in said longitudinal direction; the piecing elements of the top set being spaced from the piercing elements of the bottom set in the second longitudinal direction to a distance which is considerably smaller than that between adjacent slat-units.

When the threat is of a kind having a hollow envelope, such as for example, hollow-charge projectiles such as e.g. RPGs, the piercing elements are configured for piercing this envelope for the purpose of neutralizing it. The piercing elements can be made of a ballistic material having sufficient toughness to penetrate the envelope of the incoming projectile upon its impact with a respective slat.

In order to increase the penetration capability of the piercing elements, at least a part of them can each be formed with a plurality of sharp edges, facilitating more efficient penetration thereof into the projectile. In particular, the piercing element can have a body with a plurality of surfaces (either curved or planar) angled with respect to each other, with sharp edges formed at the intersection between two or more of said surfaces.

The shape, dimensions and/or orientation of the piercing elements can vary in a direction away from the rear end. This varying can be such that the distance between the piercing elements of the top and bottom sets increase in the direction away from the rear end. The slat unit can have a greater dimension along the second direction at the strike end than at the rear end. The piercing elements of the top and bottom sets can be outwardly tapered in order to increase their penetration capability into the incoming projectile.

The tapering angle between the piercing elements of the top set and of the bottom set can be chosen not to exceed 100°, more particularly not to exceed 80°, even more particularly not to exceed 60°, still more particularly not to exceed 40° and still more particularly not to exceed 20°.

The top and bottom sets can be aligned with one another so that piercing elements of the top set are aligned in the second direction with corresponding piercing elements of the bottom set. Alternatively, the top and bottom sets can be arranged at an offset so that piercing elements of the top set are directly opposed the space between the piercing elements of the bottom set.

It is appreciated however that when the piercing elements of the top and the bottom slats are aligned, i.e. the spacing between two neighboring piercing elements of the top slat is opposite the spacing between two neighboring piercing elements of the bottom slat, bending stresses within the slat unit (upon impact of a projectile) are reduced since the slat unit can bend, in a direction perpendicular to the impact direction, more easily.

The piercing elements of each of the top and bottom sets can be integrally formed as a unitary body. Moreover, each such unitary body can comprise a rear portion extending from the piercing elements towards the rear end of the slat unit. In particular, the extension of the rear portion along the anticipated impact direction can be considerably greater than the extension of the piercing elements along this direction.

One or more of the piercing elements can have an extension towards said anticipated impact direction which does not exceed twice the maximal width of the piercing element, thereby providing the piercing element with a required robustness to penetrate the envelope of the projectile.

In accordance with a particular design, each of the top set and the bottom set can have a serrated or a saw-like design, with a succession of teeth extending along the longitudinal axis of the slat unit, the teeth constituting the piercing elements.

The piercing element of a set (top, bottom or both) can be integrally formed with the strike end of the slat unit, i.e. the strike end and the piercing elements constituting a unitary body made of a single material. In particular, the arrangement can be such that the length of the piercing elements along the anticipated impact direction is considerably smaller than the remainder of the slat in the same direction.

According to one example, the slat unit can be pre-formed as a single, unitary slat body, the strike end of which is made to create the top set and the bottom set of piercing elements.

According to another example, the slat unit can comprise a top sub-slat and a bottom sub-slat being formed with a top set and a bottom set of piercing elements, respectively. The top sub-slat and the bottom sub-slat can be attached to each other along respective side surfaces thereof in order to form the slat unit.

In addition, each of the sub-slats can be constituted by a plurality of sub-slat members spaced from one another along the first longitudinal direction. Such an arrangement of discrete separated sub-slat members can facilitate reduction of bending stresses within the slat unit upon impact of the threat. Furthermore, under such an arrangement, if the slat unit bends, it may then return to its original shape while only the sub-slat portion directly impacted by the threat is damaged and/or deformed while the other sub-slat members remain intact.

According to a variation on the above example, the slat unit can comprise a spacer layer sandwiched between the top sub-slat and the bottom sub-slat and providing the required spacing between the top and bottom sets. In particular, the spacer layer can be made of a material having a lower toughness and/or ballistic capability than that of each of the sub-slats. In accordance with a specific design of the slat unit, the spacer material can be a composite material while each of the sub-slats can be made of metal. The composite material can be made, for example, of any of the following: Polyester, vinyl ester and epoxy. The composite material can be encapsulated by a binding cover made of a fiber-reinforced resin. According to one particular example, the fiber reinforcement of the binding cover can be provided, e.g. by fiberglass.

The sub-slats can be fixedly attached to the spacer material to constitute an integral body. In particular, attachment between the spacer material and the sub-slats can be provided by any of the following: bolting, welding, adhesive material, external wrapping etc.

Under a particular design, the sub-slats are attached to the spacer layer by rivets passing through the spacer material and having one end fixedly attached to the top sub-slat and another end fixedly attached to the bottom sub-slat.

In accordance with a specific example, the spacer layer can be in the form of a longitudinal spacer slab formed with a front portion and a rear portion. The front portion can be formed with two cut-outs (one—at its top, and the other—at its bottom) configured for receiving therein the top and bottom sub-slats respectively, the body of the front portion being therefore thinner than the rear portion in the second direction. The dimensions of the cutout and the sub-slats can be such that, when the top and bottom sub-slats are positioned within the respective cut-outs of the front portion of the spacer layer, a top surface of the top sub-slat is flush with a top surface of the rear portion of the spacer slab and a bottom surface of the bottom sub-slat is flush with a bottom surface of the rear portion of the spacer slab. In addition, a rear surface of each of the top and bottom sub-slats can be mated against a front surface of the rear portion of the spacer slat.

Under the above arrangement, the top and bottom surfaces of the front portion of the spacer layer can be configured for supporting a majority of the body of each of the top and bottom sub-slats so that, during impact of said incoming projectile, the rear portion of the spacer slab provides ballistic support and cushioning for the top and bottom sub-slats. In particular, such support can result in the reinforcement of the entire hybrid slat armor against bending stresses generated during impact of the threat.

The entire slat unit can be provided with protective cover encapsulating at least a majority of the slat unit and of the piercing elements and configured for at least one of the following:

- protecting individuals handling the slat-armor from injury by the piercing elements;
- providing each of the slat units with a tight packaging facilitating the holding together of the various components of the slat unit; and
- providing the slat unit with survivability, weather resistance, water-tight sealing and/or anti-vandalism capabilities.

The protective cover can be made of an elastic material configured for expanding and contracting. According to a particular example, the protective cover can be in the form of a longitudinal sleeve into which said slat unit is configured for being inserted. The elastic nature of the material can allow inserting the slat unit into the sleeve, whereafter the sleeve contracts around the slat unit in order to the provide the above mentioned tight packaging. The sleeve can be made of a shrinkable material, in which case after the slat is inserted therein, the sleeve is brought into conditions required for the material to first shrink and then be fixed in the shrunk state such as, e.g. heating and cooling of the sleeve.

In accordance with a further aspect of the subject matter of the present application, there is provided a hybrid slat armor configured for protecting a body against a threat having an anticipated impact direction, said hybrid slat armor comprising a plurality of slat units, each extending along a first longitudinal direction, the units being spaced apart along a second direction perpendicular to the first direction; each slat unit having a strike end configured for facing the anticipated impact direction, a rear end opposite said strike end, a top set of piercing elements and a bottom set of piercing elements, the piercing elements of each set being successively arranged along the longitudinal direction of the slat unit at the strike end thereof and being spaced apart in said longitudinal direction; at least a majority of each of said slat units being tightly encapsulated by a protective cover.

It is appreciated that encapsulating each of the slat units within a protective sleeve provides both for facilitating mechanical integrity of the slat unit (in operation as well as in transport) and for prevention of injuries to personnel by the piercing elements.

It is further noted that the basic design of a slat armor requires the existence of spacing between each two neighboring slat units, so as to minimize the risk of the fuse of the incoming threat from impacting solid material and causing detonation of the hollow charge. Therefore, each of the slat units can be provided with an individual covering sleeve (rather than simple encapsulation of the entire slat armor with a covering sleeve), providing the above advantages while maintaining the required spacing between slat units.

It is also noted that the covering sleeve is designed such that, on the one hand, it is configured to maintain its integrity (i.e. not to tear or rupture) during transport and non-impact operation (thereby providing the required protection from the piercing elements) and, on the other hand, is configured to lose its integrity and tear upon impact of the incoming threat, exposing the piercing elements to the latter.

Thus, it should be understood that in term of the incoming threat, the covering sleeve is essentially non-existent in the sense that it does not interfere with the piercing elements in their required piercing operation of the envelope of the incoming threat.

In accordance with still further aspect of the subject matter of the present application, there is provided a hybrid slat armor configured for protecting a body against a threat having an anticipated impact direction, said hybrid slat armor comprising a plurality of spaced-apart slat units extending between a first support member and a second support member, the slat units being oriented generally parallel to one another and having two longitudinally opposed ends, each slat unit comprising a first attachment module, which at least in use receives therein a first end of the slat unit in a first manner and is attached to said first support member in a second manner, and a second attachment module which at least in use receives therein the second end of the slat unit in one of said first and second manners and is attached to said second support member, in the other of said first and second manners, at least one of said first and second manners being configured to provide detachable attachment.

Under the above arrangement, each of the slat units can be individually and selectively removable from the hybrid slat armor by at least one of the following:

- detachment of the first and second attachment modules from the respective first and second ends of the slat unit; and
- detachment of the first and second attachment modules from the respective first and second support member.

In accordance with a particular example, the attachment modules can be configured for being permanently attached to one of the support members and be detachably attached to one end of one of the slat units.

In particular, the attachment module can have an open cavity sized and shaped for receiving therein a respective end of the slat unit. The attachment module can further comprise securing elements configured for securely detachably attaching the sleeve portion to the respective end of the slat unit.

The securing elements can be bolts. Under one design configuration, the arrangement can be such that tightening the bolt can entail both securing of the slat to the sleeve portion as well as tightening the sleeve portion about the support member.

According to one example, the attachment modules, though permanently attached to the support members, can be configured for sliding displacement along the support members, allowing a modular design of the hybrid slat armor in which the spacing between the slat units and, possibly, their number can be dynamically changed based on ballistic requirements.

The support members can comprise end attachment units configured for articulation of the entire hybrid slat armor to a body to be protected, for example a vehicle. In particular, the end attachment units can be configured for suspending the hybrid slat armor from a designated portion of the body to be protected, providing a stand-off distance between the hybrid slat armor and the body.

In accordance with a particular example, the support members can be flexible. In particular, the support members can be in the form of cables along which the attachment modules are attached.

In accordance with still another aspect of the subject matter of the present application there is provided a hybrid slat armor configured for protecting a body against a threat having an anticipated impact direction, said hybrid slat armor comprising a plurality of slat units, each extending along a first longitudinal direction, the units being spaced apart along a second direction perpendicular to the first direction; each slat unit having a strike end configured for facing the anticipated impact direction, a rear end opposite said strike end, and comprises a base layer and at least one slat attached thereto, the slat being made of metal and comprising at least one piercing element configured for penetrating an envelope of the threat upon impact of the latter on the hybrid slat armor, and the base layer being made of material other than that of the slat and being incapable of said penetrating if said slat was made therefrom.

The material of the base layer can be other than metal, e.g. it can be composite material, and it can have a lower hardness than that of said metal. In particular, the metal can be a ballistic metal such as steel whereas the material of the base layer can be Polyester, vinyl ester, epoxy etc. The composite material can be encapsulated by a binding cover made of a fiber-reinforced resin, and, according to one particular example, the fiber reinforcement of the binding cover can be provided by fiberglass.

In addition, the ratio between the thickness of a front portion of the base layer and the thickness of the slat (measured along the second direction in a cross-section taken along a plane of the first direction) can range between 3:1 to 1:5, more particularly 2:1 to 1:4, even more particularly 1:1 to 1:2.

In the case each slat unit comprises a bottom slat and a top slat (each attached to a different surface of the front portion of the base layer, the thickness of the layer defines the distance between the top and the bottom slat. Thus, such a thickness should correspond to the requirement that the distance between the top and the bottom slat is considerably greater than the distance between two neighboring slat units.

In addition, the thickness of a rear portion of the base layer can be greater than the thickness of the front portion, thereby providing cushioning to a rear portion of the slat. Thus, the ration between the thickness of the rear portion of the base layer and the thickness of the slat (measured along the second direction in a cross-section taken along a plane of the first direction) can range between 6:1 to 1:3, more particularly 5:1 to 1:2, even more particularly 4:1 to 1:1.

Per the above, the volume of the base layer can constitute between 20-60% of the overall volume of the entire slat unit.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
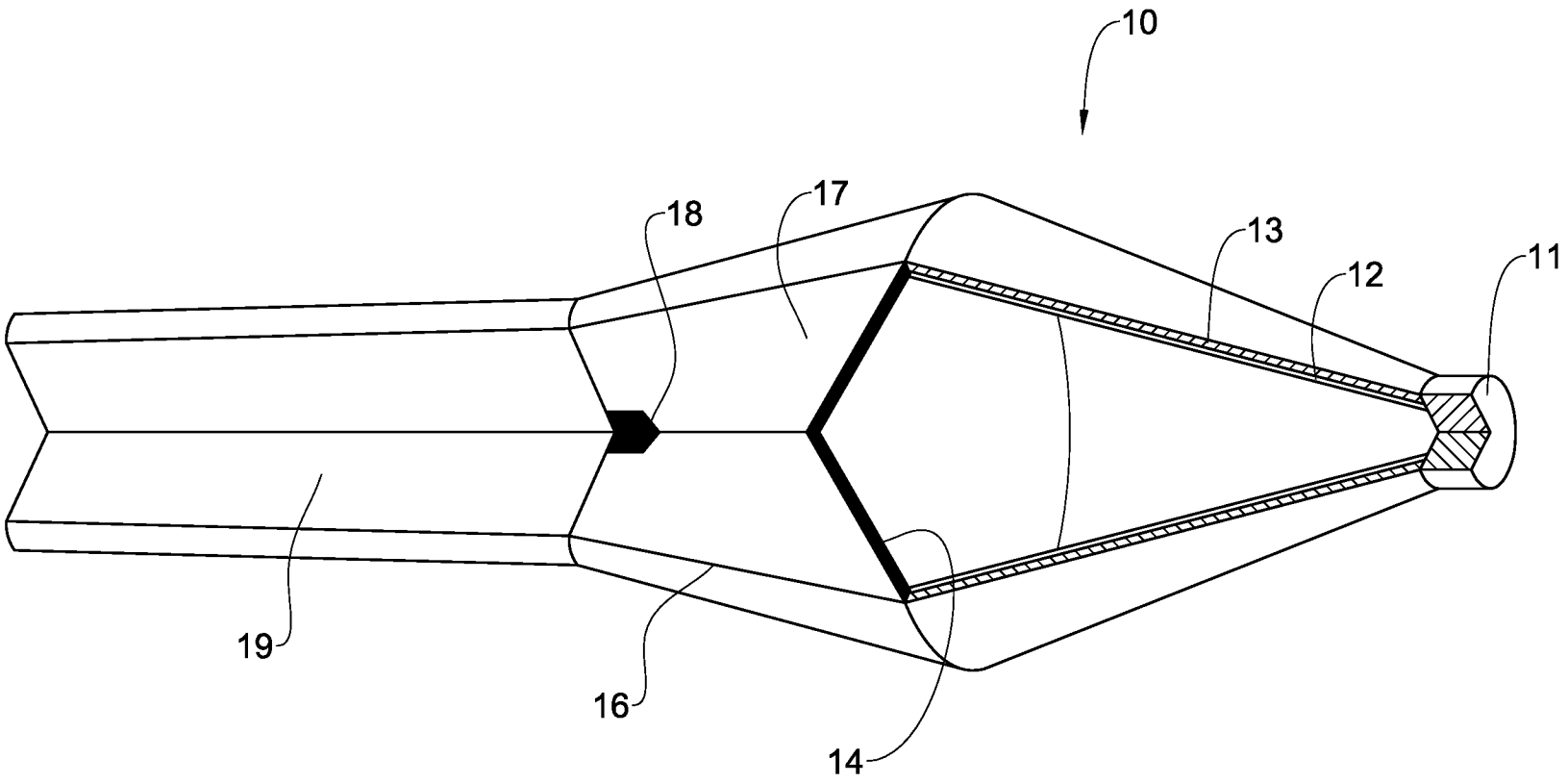
FIG. 1 is a schematic longitudinal isometric cross-sectional view of a prior art RPG missile.
Figure 2A:
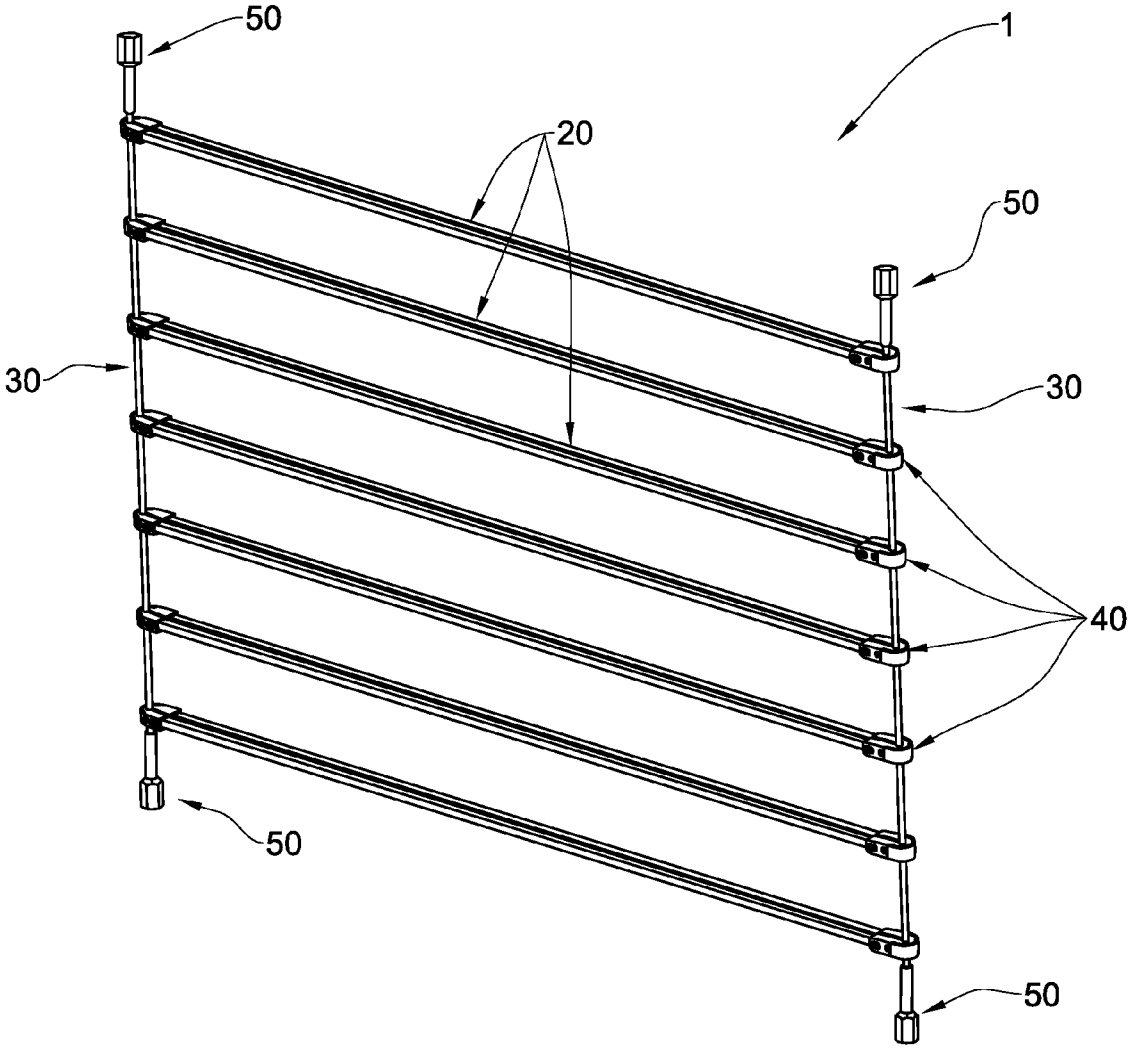
FIGS. 2A and 2B are schematic isometric and front views of a hybrid slat armor according to the subject matter of the present application.
Figure 2B:
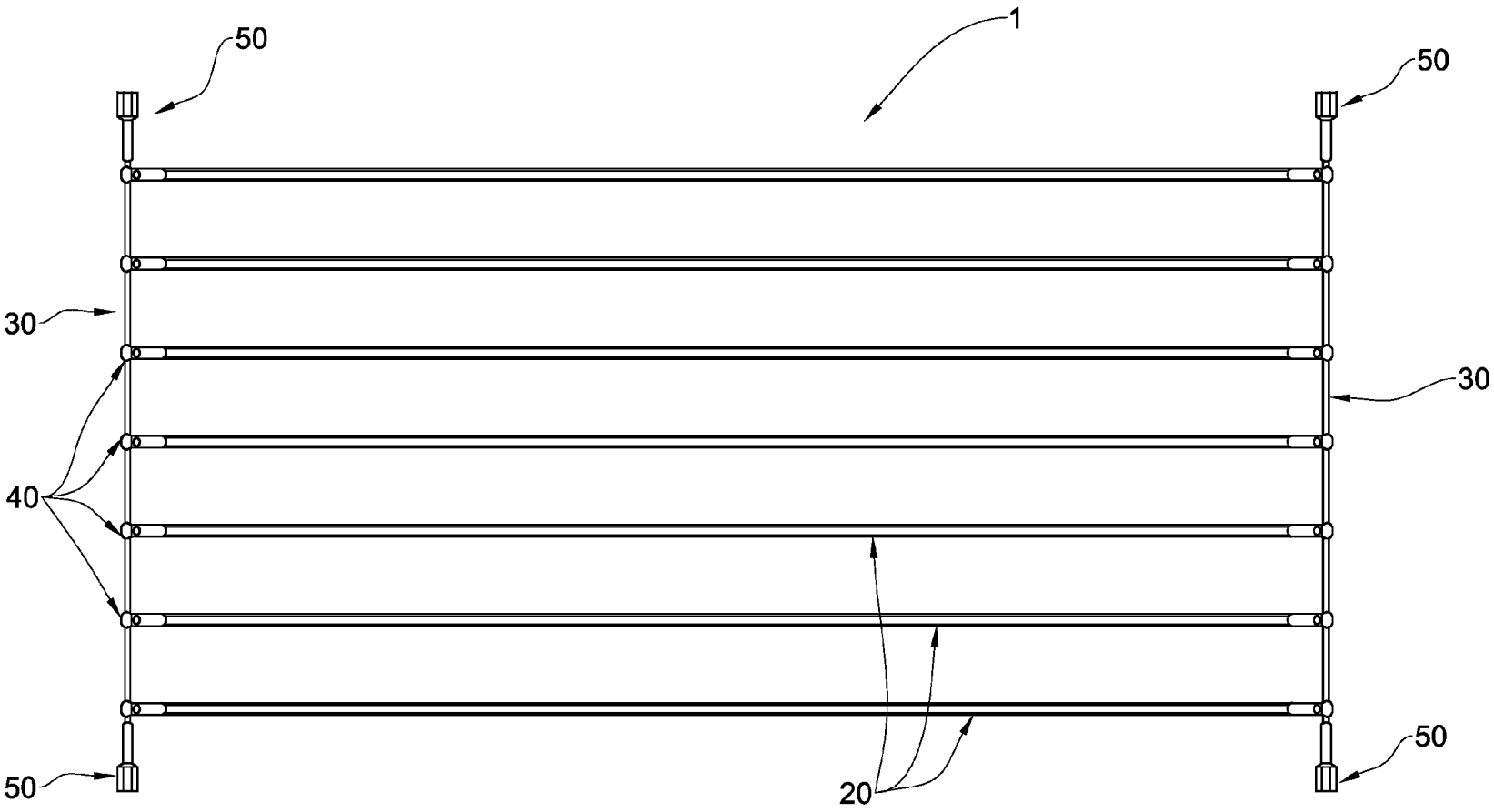

Attention is first drawn to FIGS. 2A and 2B, in which a hybrid slat armor of the present application is shown, generally being designated as 1 and comprising a plurality of slat units 20 suspended between two support members 30. The slat units 20 are articulated to the support member 30 via attachment modules 40 and the entire hybrid slat armor 1 is configured for being attached to a body to be protected (e.g. a vehicle) by end attachments 50 disposed at each end of each of the support members 30.

The hybrid slat armor 1 is configured for protecting a body from the RPG 10, and so the spacing between the slat units 20 is chosen according to the diameter of the RPG 10. In particular, the arrangement is such that the spacing is approximately equal to half the maximal diameter of the RPG 10, ensuring that when impacting the hybrid slat armor 1, the conical envelope 12, 13 of the RPG 10 will encounter the slat units 20.

Figure 3A:
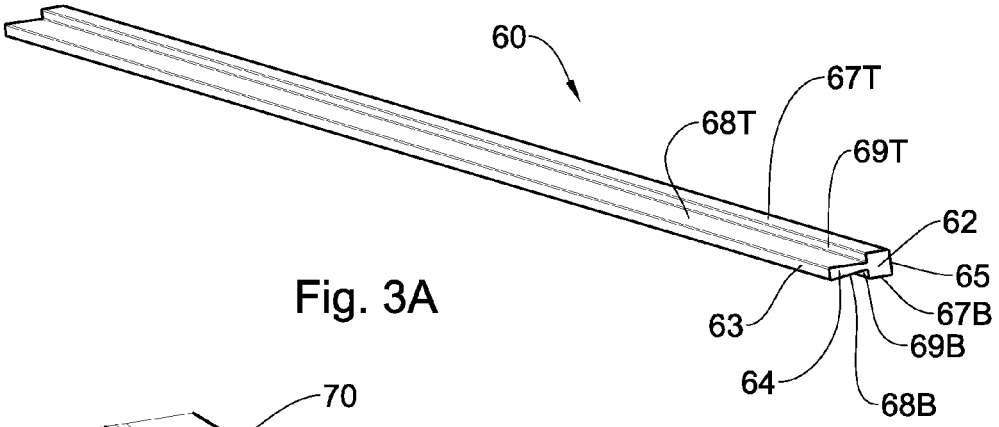
FIGS. 3A to 3C are schematic isometric views of a slat unit used in the hybrid slat armor shown in FIGS. 2A and 2B during various assembly stages thereof.
Figure 3B:
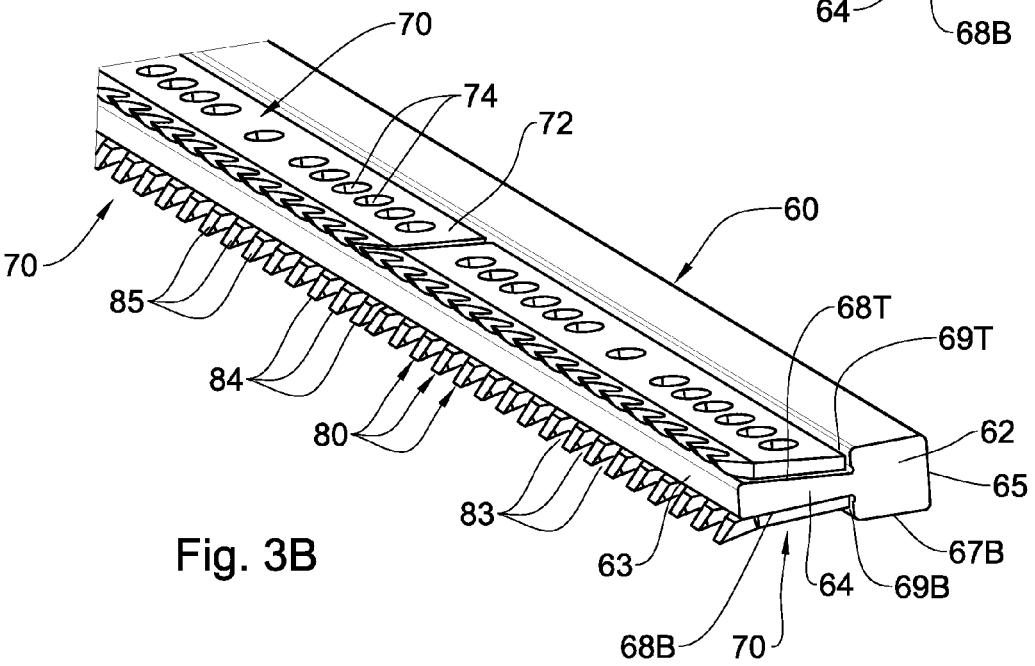
Figure 3C:
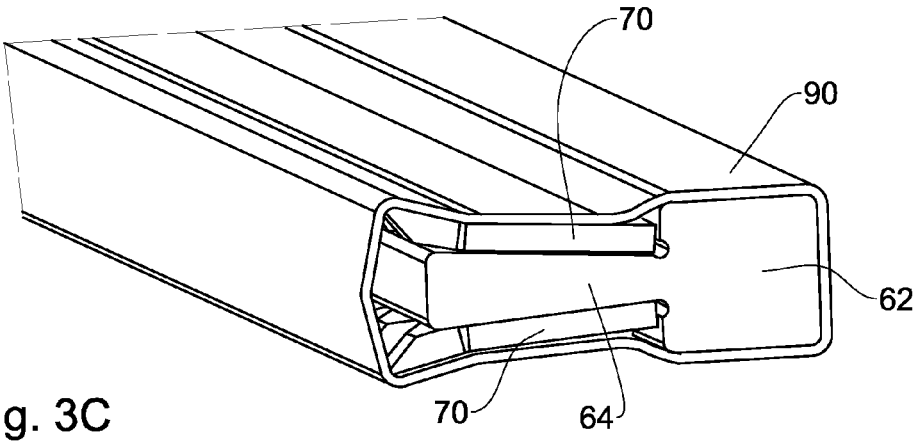

Turning now to FIGS. 3A to 3C, the slat unit 20 is shown comprising a composite base 60 and a plurality of slat panels 70 disposed on each side of the composite base 60 to be spaced from one another.

The composite base comprises a rear support portion 62 having a rear surface 65 and a front substrate portion 64 having a strike surface 63, the substrate portion being configured for positioning thereon of the slat panels 70. The rear support portion 64 has a greater thickness than the front substrate portion 62 so that there are formed two seats configured for accommodating therein the slat panels 70.

The arrangement is such that when the slat panels 70 are positioned within the seats, the bottom/top surfaces of the panels are mated with the top and bottom surfaces 68T, 68B respectively, and a rear surface of each of the slat panels 70 is mated against support surfaces 69T, 69B of the rear support portion 62 of the composite base 60.

Each of the slat panels 70 comprises a main body 72 having a generally rectangular shape and formed with perforations 74 extending therealong in the first longitudinal direction, configured for allowing articulation between the top and bottom slat panels 70 and the base composite 60.

Each of the slat panels 70 comprises a set of piercing elements 80 having a tapering extension 85 towards the impact direction, each being formed with a sharp edge 84 configured for tearing/deforming the envelope of the incoming threat. The piercing elements 80 are spaced from one another 83 facilitating more efficient penetration into the threat envelope upon impact therewith.

Top and bottom slat panels 70 are affixed to one another and to the base composite 60 using rivets (not shown) passing through the perforations 74 and through base composite 60.

It is appreciated that the slat unit 20 comprises a plurality of both top and bottom slat panels 70 which are spaced from one another. This arrangement provides the slat unit 20 with a greater flexibility and allows reducing bending stresses upon impact of the incoming threat.

In addition, it is noted that aligned top and bottom panels 70 are arranged such that the piercing elements 80 of a top slat panel 70 are aligned opposite the piercing elements 80 of a bottom slat panel 70, and, consequently, the spaces between two neighboring piercing elements 80 are also aligned opposite the spaces between neighboring piercing elements 80 of the bottom panel. This arrangement also serves for reducing bending stresses. In particular, if the arrangement were misaligned, i.e. a piercing element 80 of the bottom slat panel 70 were aligned opposite a space between two neighboring piercing elements 80 of a top slat panel 70, upon a bending force applied to the slat unit 20 at the above space, the piercing element 80 of the bottom slat panel would receive all the bending stresses.

With particular reference being made to FIG. 3C, once the slat panels 70 have been mounted to the base composite 60 and affixed thereto, a protective cover 90 is applied to encapsulate the base composite 60 and slat panel 70 assembly. The protective cover 90 is in the form of a resilient sleeve which can be heated, pulled over the base composite 60 and slat panels 70 and then cooled to compactly encapsulate them and form the slat unit 20.

Figure 4A:
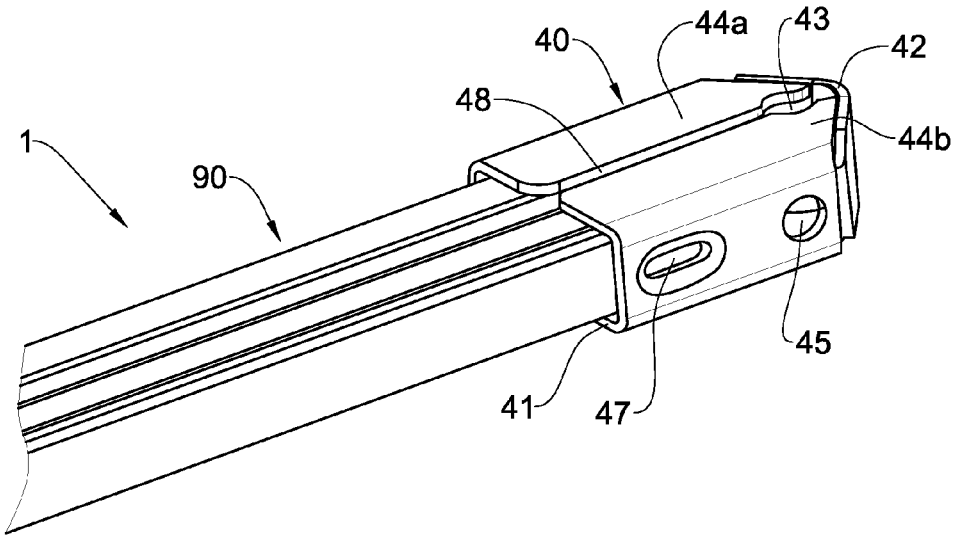
FIG. 4A is a schematic isometric view of an end portion of the slat unit shown in FIGS. 3A to 3C, with an attachment module.
Figure 4B:
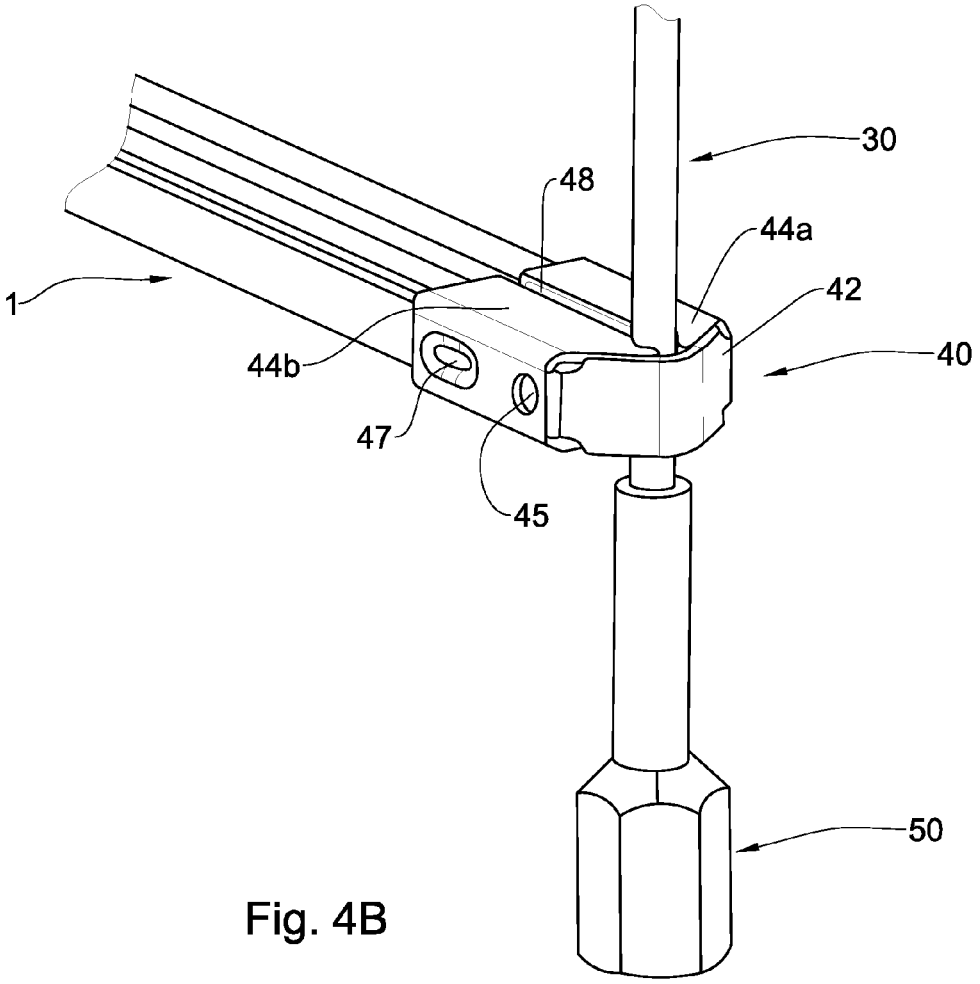
FIG. 4B is a schematic isometric view of the slat unit shown in FIG. 4A, when attached to a support member of the hybrid slat armor.
Figure 4C:
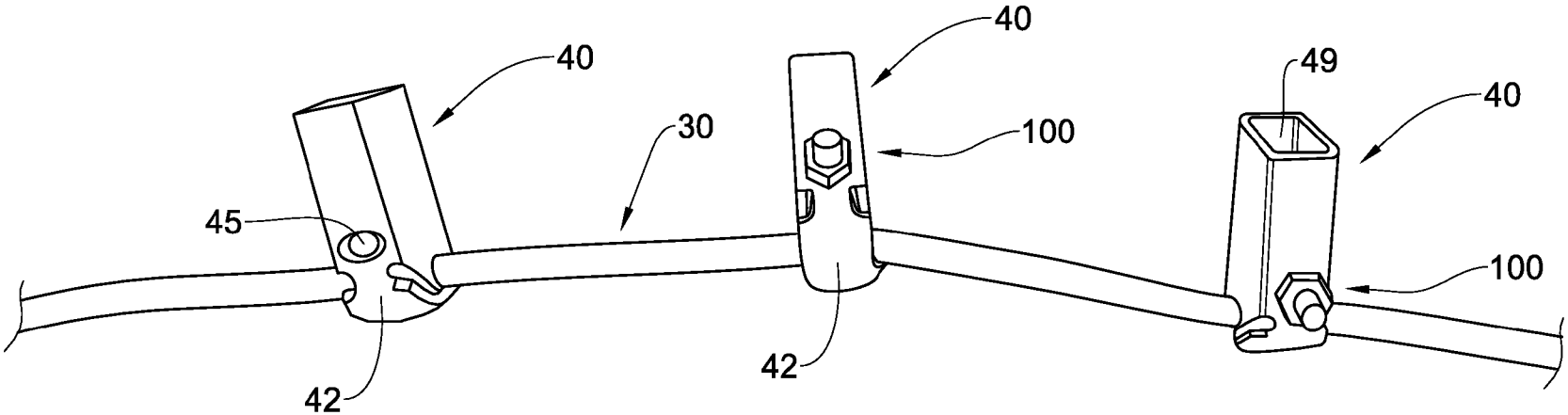
FIG. 4C is a schematic perspective view of a support member of the hybrid slat armor having mounted thereon a plurality of attachment modules as shown in FIGS. 4A and 4B.

Attention is now drawn to FIGS. 4A to 4C, in which the attachment module 40 of the hybrid slat armor 1 are shown. In particular, each attachment module 40 is in the form of a sheet bent cup 41 having a main cavity 49 configured for receiving therein an end of the slat unit 20.

The cup 41 comprises two flanges 44*a*, 44*b* configured for closing over the slat unit 20 and a deformable extension 42 configured for being bent around the support members 30 for the purpose of attachment thereto. The cup further comprises a recess 43 for receiving therein the support member 30. In addition, the cup 41 comprises securing hole 45 for receiving therein a securing bolt 100 (FIG. 4C) and a depression hole 47 configured for applying pressure to the slat unit 20 in order to both secure and align the slat unit 20 during assembly.

In assembly, the cup 41 is positioned on the support member 30 (a cable) so that the recess 43 receives therein a portion of the support member 30. Thereafter, the deformable extension 42 is bent to close around the support member 30. In this position, by applying appropriate pull, the attachment module 40 can be displaced along the support member 30.

In addition, the support member 30 can comprise a mounting sleeve (not shown) circumferentially surrounding the support member 30 along a portion thereof corresponding to the width of the attachment module 40 so that, when mounted, the deformable extension 42 closes over the sleeve and not the support member itself. The sleeve thus serves both for indicating the location/s at which the attachment modules 30 should be mounted as well as for guarding the support member 30.

Once the attachment modules 30 are mounted as above, an end portion of the slat unit 20 is inserted into the cavity 49 of the cup and a bolt and nut assembly 100 is passed through holes 45 of the attachment module 40, so that tightening of the bolt and nut assembly 100 brings the flange portions 44*a*, 44*b* towards one another. This serves two purposes: (a) affixing the slat unit 20 to the attachment module 40; and (b) narrowing of the recess 43 so as to affix the attachment module 40 to the support member 40.

In addition, once tightened, the depression hole 47 pushes in against the protective cover so that a depressed tip thereof aligns itself opposite the base composite 60 and between the top and bottom slat panels 70.

The entire hybrid slat armor 1 can be suspended from the body (not shown) to be protected using the end attachment 50. In particular, the body can comprise a stand-off arrangement extending perpendicular to the body in the impact direction so that the hybrid slat armor 1 can be suspended vertically from the stand-off arrangement.

In operation, when an incoming threat (e.g. RPG) impacts the hybrid slat armor 1, in most cases, the top of the RPG passes between two neighboring slat units 20. As such, the interaction with the envelope of the RPG takes place with the bottom slat panels 70 of the top of the two slat units 20 and the top slat panels 70 of the bottom of the two slat units 20.

Upon impact, the piercing elements 80 penetrate the conical envelope of the RPG and are supported, along the impact direction, by the width of the slat panels 70 and by the rear support portion 62 of the base composite 60.

Upon further progression of the RPG towards the body to be protected, due to the tapering shape of the piercing elements 80 and their penetration into the RPG, the bottom slat panels 70 of the top of the two slat units 20 and the top slat panels 70 of the bottom of the two slat units 20 are detached from the base composite 60 and continue together with the RPG (which is already neutralized due to breech of its envelope.

The invention claimed is:

1. A hybrid slat armor configured for protecting a body against a threat having an anticipated impact direction, the hybrid slat armor comprising:

a plurality of slat units, each of the plurality of slat units extending along a first longitudinal direction, the plurality of slat units being spaced apart along a second direction generally perpendicular to the first direction, each of the plurality of slat units including:

a strike end configured for facing the anticipated impact direction;

a rear end opposite said strike end;

a top set of piercing elements;

a bottom set of piercing elements that are separate from the top set of piercing elements;

a top sub-slat formed with the top set of piercing elements; and a bottom sub-slat formed with the bottom set of piercing elements;

wherein the top sub-slat and the bottom sub-slat are sandwiched along respective side surfaces thereof;

wherein the piercing elements of each of the top and bottom sets are successively arranged along the longitudinal direction of the slat unit at the strike end thereof and being spaced apart in said longitudinal direction, the piecing elements of the top set being spaced from the piercing elements of the bottom set in the second direction to a distance that is considerably smaller than that between adjacent slat units of the plurality of slat units.

2. The hybrid slat armor according to claim 1, wherein the piercing elements are made of a ballistic material and configured for penetrating an envelope of the incoming threat upon its impact with a respective slat.

3. The hybrid slat armor according to claim 1, wherein at least a part of the piercing elements are each formed with a plurality of sharp edges, facilitating more efficient penetration into the threat.

4. The hybrid slat armor according to claim 1, wherein the piercing elements of the top and bottom sets are outwardly tapered.

5. The hybrid slat according to claim 4, wherein a tapering angle between the piercing elements of the top set and of the bottom set is chosen to be no greater than 60°.

6. The hybrid slat armor according to claim 1, wherein the top and bottom sets of piercing elements are arranged at an offset so that piercing elements of the top set are directly opposed the spaced between the piercing element of the bottom set.

7. The hybrid slat armor according to claim 1, wherein the extension of a rear portion of the slat unit along the anticipated impact direction is considerably greater than the extension of the piercing elements.

8. The hybrid slat armor according to claim 1, wherein each of the top set of piercing elements and the bottom set of piercing element is in the form of a serrated or a saw-like portion including a plurality of teeth, the saw-like portion extending along the longitudinal axis of the slat unit, the plurality of teeth of said saw-like portion constituting the piercing elements.

9. The hybrid slat armor according to claim 1, wherein the length of the piercing elements along the anticipated impact direction is considerably smaller than the length of the slat in the same direction.

10. The hybrid slat armor according to claim 1, wherein the slat unit includes a spacer layer sandwiched between the top sub-slat and the bottom sub-slat and providing a spacing between the top and bottom sets.

11. The hybrid slat armor according to claim 10, wherein the spacer layer is made of a material having a lower toughness and/or ballistic capability than that of each of the sub-slats.

12. The hybrid slat armor according to claim 11, wherein the spacer material is a composite material.

13. The hybrid slat armor according to claim 1, wherein the spacer layer is in the form of a longitudinal spacer slab formed with a front portion and a rear portion, the front portion being formed with two cut-outs configured for receiving therein the top and bottom sub-slats respectively, the front portion being therefore thinner than the rear portion, such that a rear surface of each of the top and bottom sub-slats is mated against a front surface of the rear portion of the spacer slat.

14. The hybrid slat armor according to claim 1, wherein the entire slat unit is provided with protective cover encapsulating the majority of the slat unit and of the piercing elements.

15. The hybrid slat armor according to claim 1, wherein each of the plurality of slat units includes a first attachment module that, at least in use, receives therein a first end of the slat unit and is attached to a first support member; and a second attachment module that, at least in use, receives therein the second end of the slat unit and is attached to a second support member.

16. The hybrid slat armor according to claim 15, wherein each of the plurality of slat units is individually and selectively removable from the hybrid slat armor by at least one of the following:

detachment of the first and second attachment modules from the respective first and second ends of the slat unit; or detachment of the first and second attachment modules from the respective first and second support member.

17. The hybrid slat armor according to claim 16, wherein the attachment modules are configured for being permanently attached to the support members and provided with an attachment arrangement providing the selective attachment/detachment to the respective ends of the slat units.

18. The hybrid slat armor according to claim 17, wherein the attachment module includes a sleeve portion having a cavity sized and shaped for receiving therein a respective end of the slat unit.

19. The hybrid slat armor according to claim 1, wherein each of the plurality of slat units includes a base layer made of composite material and at least one slat attached thereto, the slat being made of metal and including at least one piercing element configured for penetrating an envelope of the threat upon impact of the latter on the hybrid slat armor.

* * * * *